US008909114B2

(12) United States Patent
Takeuchi

(10) Patent No.: US 8,909,114 B2
(45) Date of Patent: Dec. 9, 2014

(54) IMAGE HEATING APPARATUS

(75) Inventor: Suguru Takeuchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 13/364,702

(22) Filed: Feb. 2, 2012

(65) Prior Publication Data

US 2012/0201583 A1 Aug. 9, 2012

(30) Foreign Application Priority Data

Feb. 3, 2011 (JP) ..... 2011-021464

(51) Int. Cl.
*G03G 15/20* (2006.01)

(52) U.S. Cl.
CPC .. *G03G 15/2042* (2013.01); *G03G 2215/00561* (2013.01)
USPC ..... 399/329; 399/33; 399/67

(58) Field of Classification Search
CPC ..... G03G 15/657; G03G 15/2046; G03G 15/2042; G03G 15/2053
USPC ..... 399/33, 67–69, 320, 328, 329, 389, 400
See application file for complete search history.

(56) References Cited

U.S. PATENT DOCUMENTS 8,712,272 B2 4/2014 Takeuchi et al.
2010/0008705 A1* 1/2010 Watanabe et al. ..... 399/328
2010/0178088 A1 7/2010 Koshida et al.
2010/0189486 A1* 7/2010 Inoue ..... 399/395
2012/0248097 A1 10/2012 Takeuchi et al.

FOREIGN PATENT DOCUMENTS

JP 2001-194940 A 7/2001
JP 2003-149970 A 5/2003
JP 2003-173106 A 6/2003
JP 2010-160388 A 7/2010

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image heating apparatus includes a rotatable image heating member for heating an image on a recording material, a magnetic flux generator for generating magnetic flux for heating the image heating member, an adjustor for adjusting the magnetic flux distribution so that the magnetic flux acting on an end portion region of the image heating member with respect to a rotational axis direction of the image heating member is decreased, a changing portion for changing a sheet passing position of the recording material with respect to the rotational axis direction within a set range, and a switching portion for switching, when the adjustor is actuated and sheets of the recording material are continuously passed, the set range from a range in which the sheet passing position does not overlap with the end portion region to a range in which the sheet passing position overlaps the end portion region.

11 Claims, 12 Drawing Sheets

(a)

(b)

(a)

(b)

IMAGE HEATING APPARATUS

FIELD OF THE INVENTION AND RELATED ART

The present invention relates to an image heating apparatus of a heating belt type in which a heating length of induction heating is variably constituted. Specifically, the present invention relates to control of a sheet passing reciprocate of a recording material when sheets of the recording material are continuously subjected to heating.

An image forming apparatus in which a toner image is, after being transferred onto the recording material, heated and pressed in a heating nip of a fixing device of a roller heating type to be fixed on the recording material has been widely used. In the fixing device of the roller heating type, with the continuous heating of the sheets of the recording material, an overheating region is formed at roller end portions which are non-sheet passing regions. For this reason, control such that a relative positional relationship between the recording material conveyed into the heating nip and the heating nip is shifted has been proposed (Japanese Laid-Open Patent Application (JP-A) 2003-149970 and JP-A 2001-373178).

On the other hand, as the fixing device of a type different from the roller heating type, the fixing device of a belt heating type has been put into practical use. The fixing device of the belt heating type effects heat and pressure application to the toner image by heating a cylindrical thin heating belt member and therefore compared with the roller heating type in which a whole thick roller is uniformly heated, the weight of the member to be heated is light. Particularly, in an electromagnetic heating type in which a metal layer is provided to the heating belt member and is subjected to induction heating by an AC magnetic field, heat is concentrated at the heating belt member and therefore the fixing device (image heating apparatus) of this type can be actuated in a very short time to start heating of the recording material (JP-A 2001-194940).

However, in the image heating apparatus of the electromagnetic heating type and of the heating belt type, heat is concentrated at a portion having a very light weight and therefore heating belt member end portions as the non-sheet passing regions are heated to an excessive temperature in a short time to cause thermal deformation. As in JP-A 2003-149970 and JP-A 2001-373178, even when the relative position of the recording material is changed, in a period in which the image heating apparatus awaits passing of the recording material, a large temperature rise occurs.

Therefore, in JP-A 2010-160388, the induction heating of the heating belt member is effected by using an AC magnetic flux generating means capable of setting a heating length of the heating belt member, with respect to a widthwise direction perpendicular to a rotational direction of the heating belt member, at a plurality of levels depending on a sheet passing width of the recording material. A plurality of core members are arranged in a longitudinal direction of the heating belt member, and a magnetic reluctance of a magnetic circuit with respect to magnetic flux of the core member within a range depending on the sheet passing width of the recording material is set at a value larger than that of the magnetic reluctance of the magnetic circuit with respect to magnetic flux of the core member outside the range, so that the heat of the recording material is started. As a result, overheating of the heating belt member located outside the sheet passing width of the recording material is avoided.

As shown in JP-A 2010-160388, even when the heating length depending on the recording material sheet passing width is set, it was turned out that an overheating region is generated at a portion of the heating belt member outside the heating length to cause thermal deformation.

In the fixing device of the belt heating type, the heating of the recording material is started, at the time when a temperature distribution of the heating nip is in a uniform temperature state to the extent of the recording material width, without awaiting an equivalent state of the temperature distribution of the whole fixing device. For that reason, by keeping the temperature of the heating belt member at a constant level, heating move than that for supplementing a heat quantity taken by the recording material is always effected, so that an unexpected high temperature is generated at a portion where heat transfer (heat dissipation) is prevented or in the non-sheet passing region.

SUMMARY OF THE INVENTION

A principal object of the present invention is to provide an image heating apparatus capable of avoiding level overheating of a heating belt member by enlarging a shift range of a recording material with movement of an overheating region generated outside a sheet passing width of the recording material after continuous heating of sheets of the recording material is started.

Another object of the present invention is to provide an image heating apparatus capable of reducing a degree of temperature rise caused due to inconsistency between a width of a recording material subjected to sheet passing and a retraction region of a core.

According to an aspect of the present invention, there is provided an image heating apparatus comprising: a rotatable image heating member for heating an image on a recording material; magnetic flux generating means for generating magnetic flux for heating the image heating member; adjusting means for adjusting a magnetic flux distribution so that the magnetic flux acting on an end portion region of the image heating member with respect to a rotational axis direction of the image heating member is decreased; changing means for changing a sheet passing position of the recording material with respect to the rotational axis direction within a set range; and switching means for switching, when the adjusting means is actuated and sheets of the recording material are continuously passed, the set range from a range in which the sheet passing position does not overlap with the end portion region to a range in which the sheet passing position overlaps with the end portion region.

These and other objects, features and advantages of the present invention will become more apparent upon a consideration of the following description of the preferred embodiments of the present invention taken in conjunction with the accompanying drawings.

Figure 6:
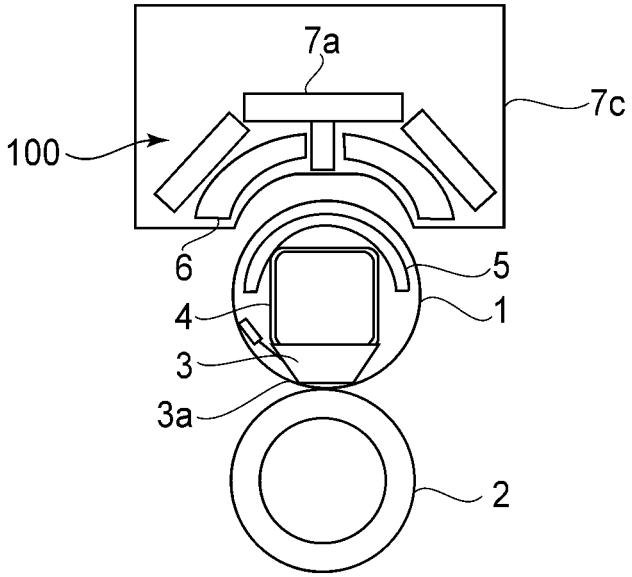
Figure 6:
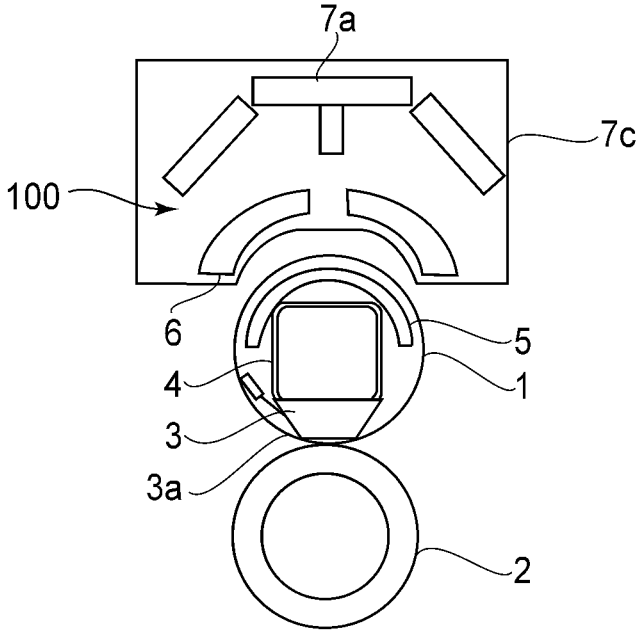

Parts (a) and (b) of FIG. 6 are illustrations of an operation of the outside magnetic core.

Figure 7:
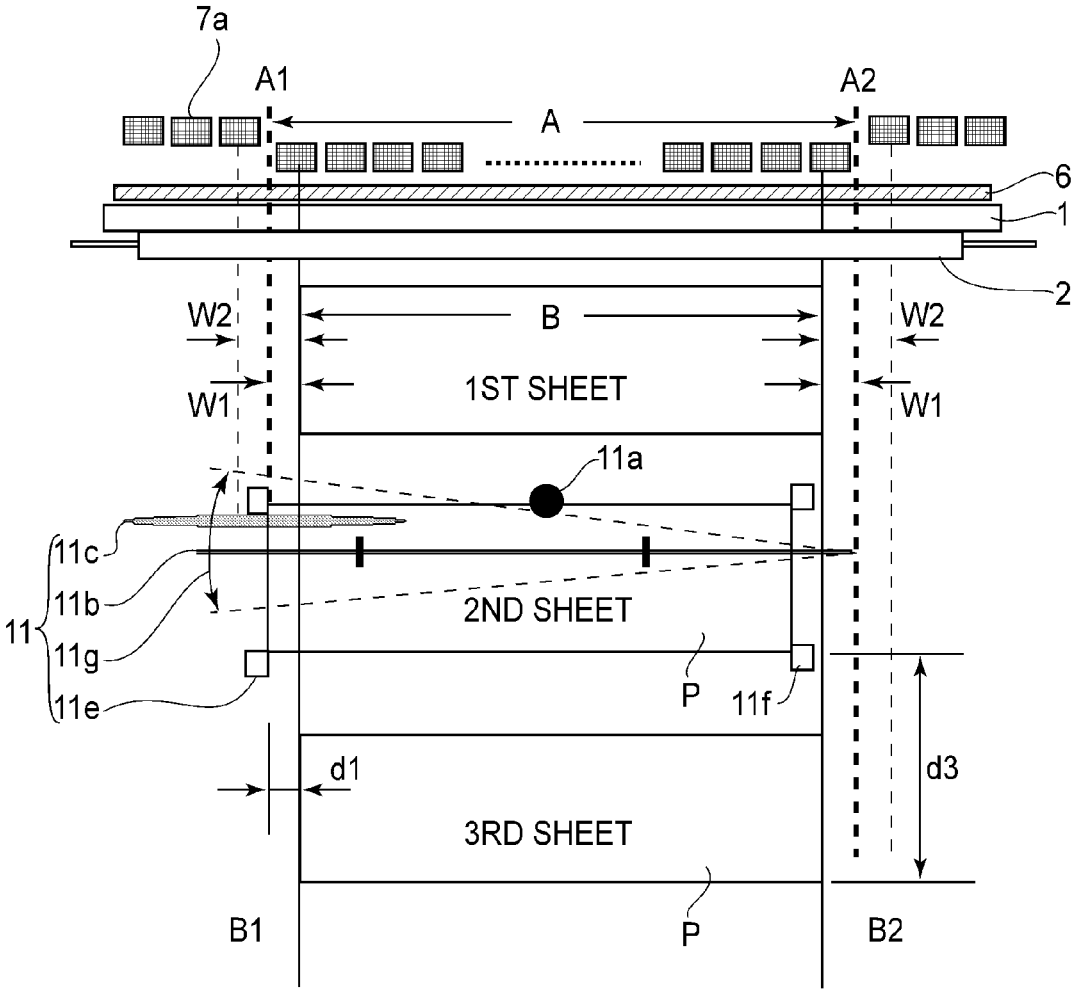

FIG. 7 is an illustration of a recording material shift mechanism.

Figure 8:
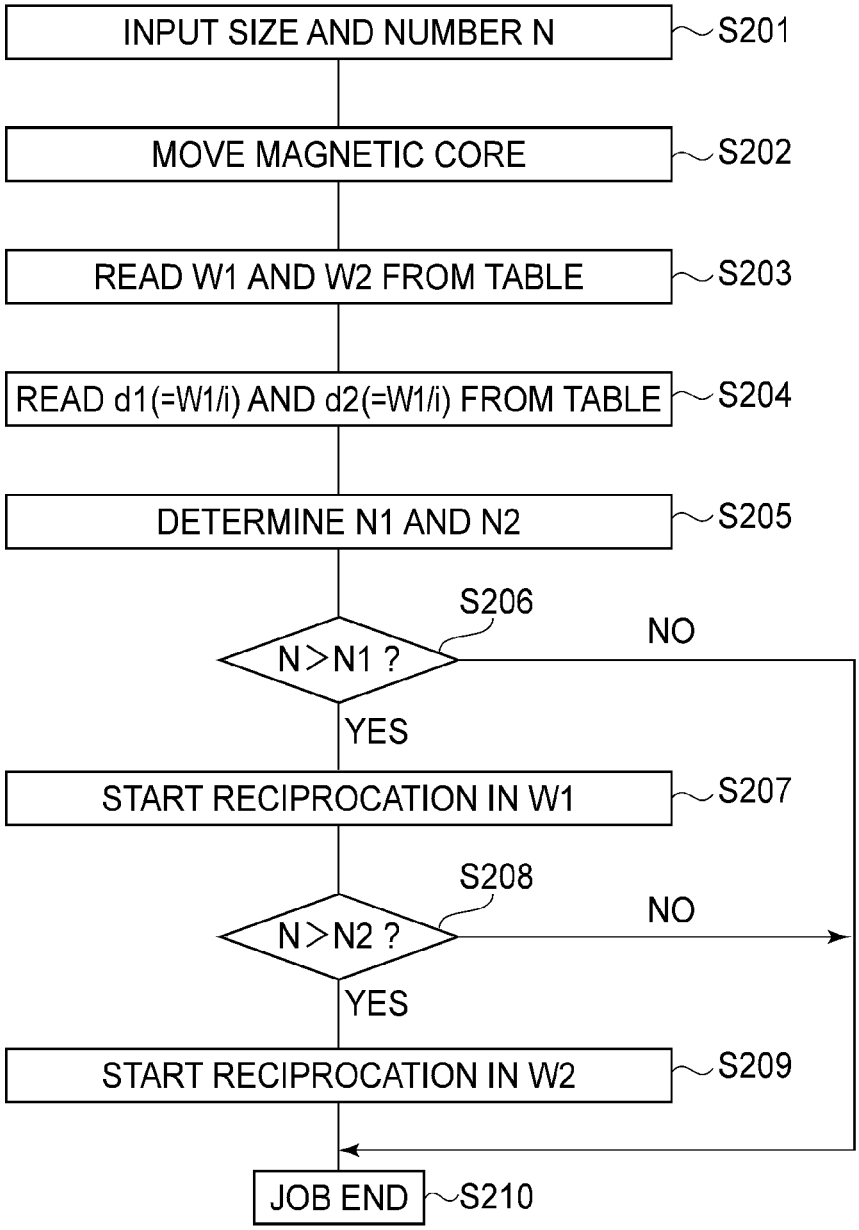

FIG. 8 is a flow chart of sheet passing control in Embodiment 1.

Figure 9:
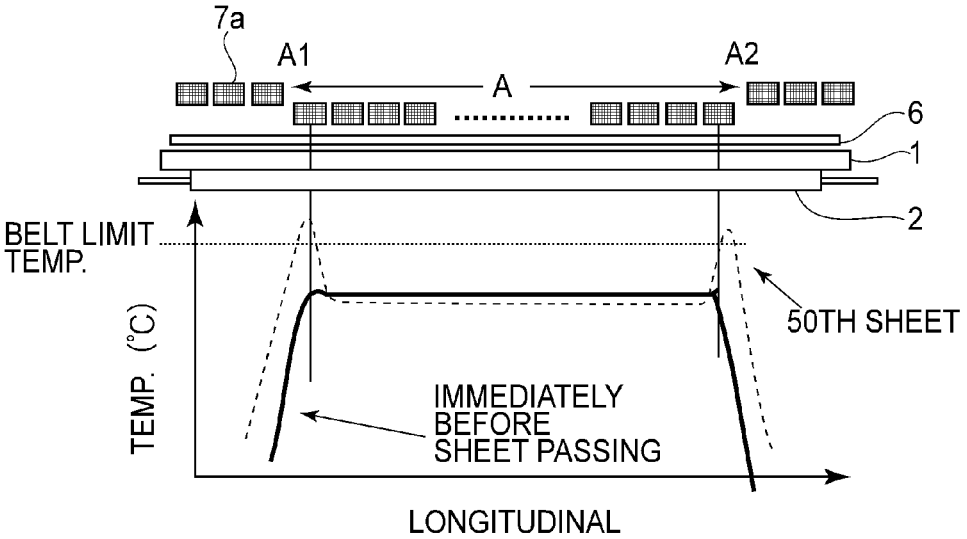

FIG. 9 is an illustration of end portion temperature rise in the case where a recording material is not reciprocated.

Figure 10:
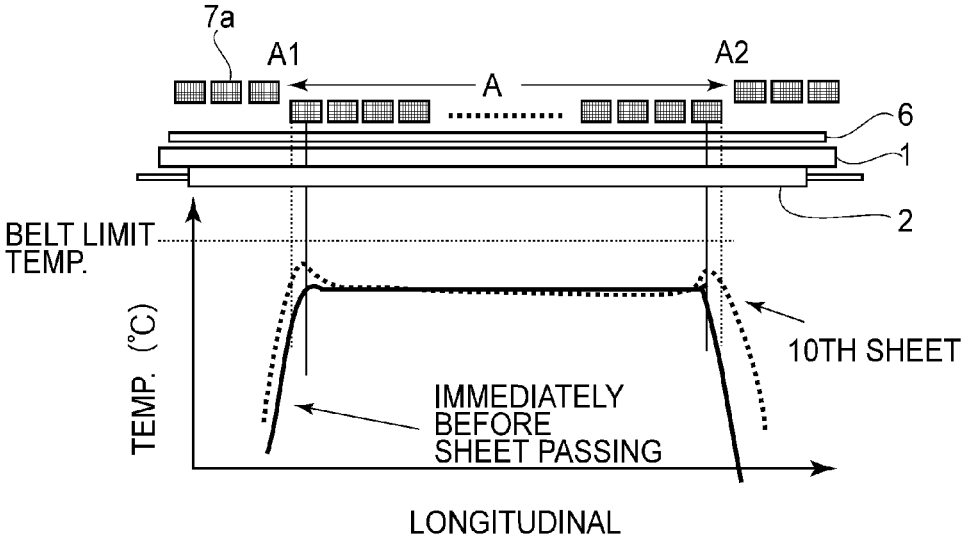

FIG. 10 is an illustration of timing of reciprocation of the recording material.

Figure 11:
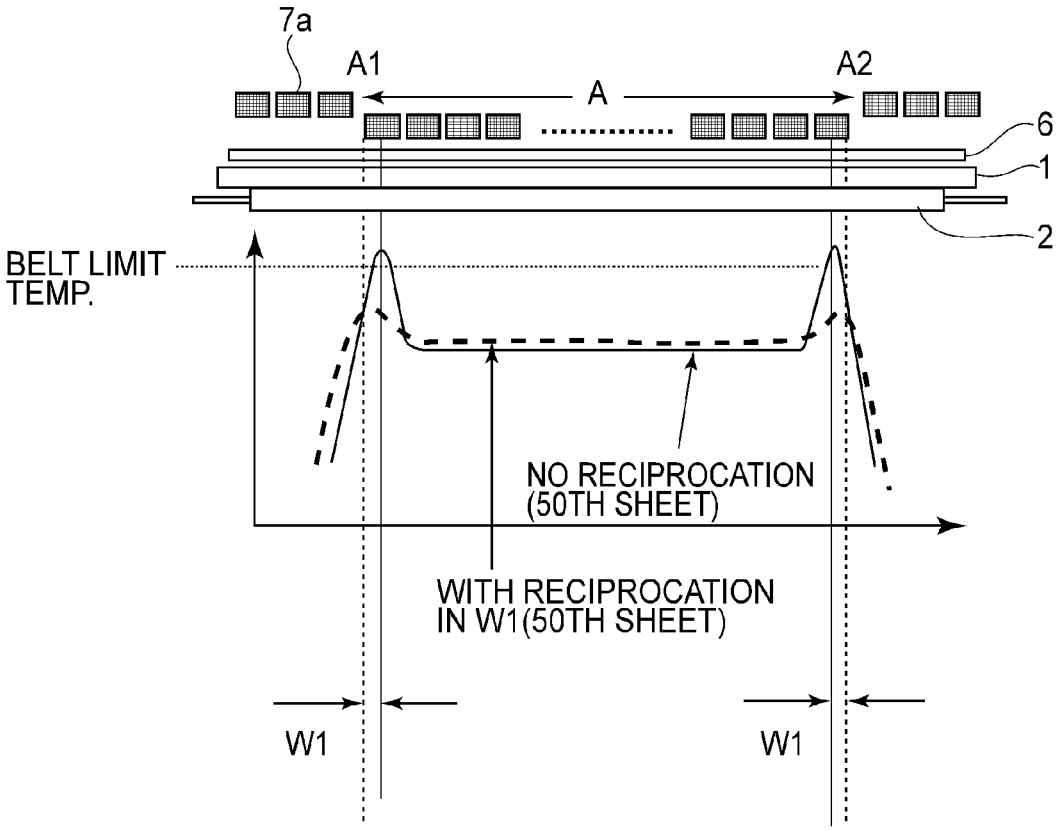

FIG. 11 is an illustration of the end portion temperature rise at the time of sheet passing of 50th sheet in the case where the recording material is reciprocated.

Figure 12:
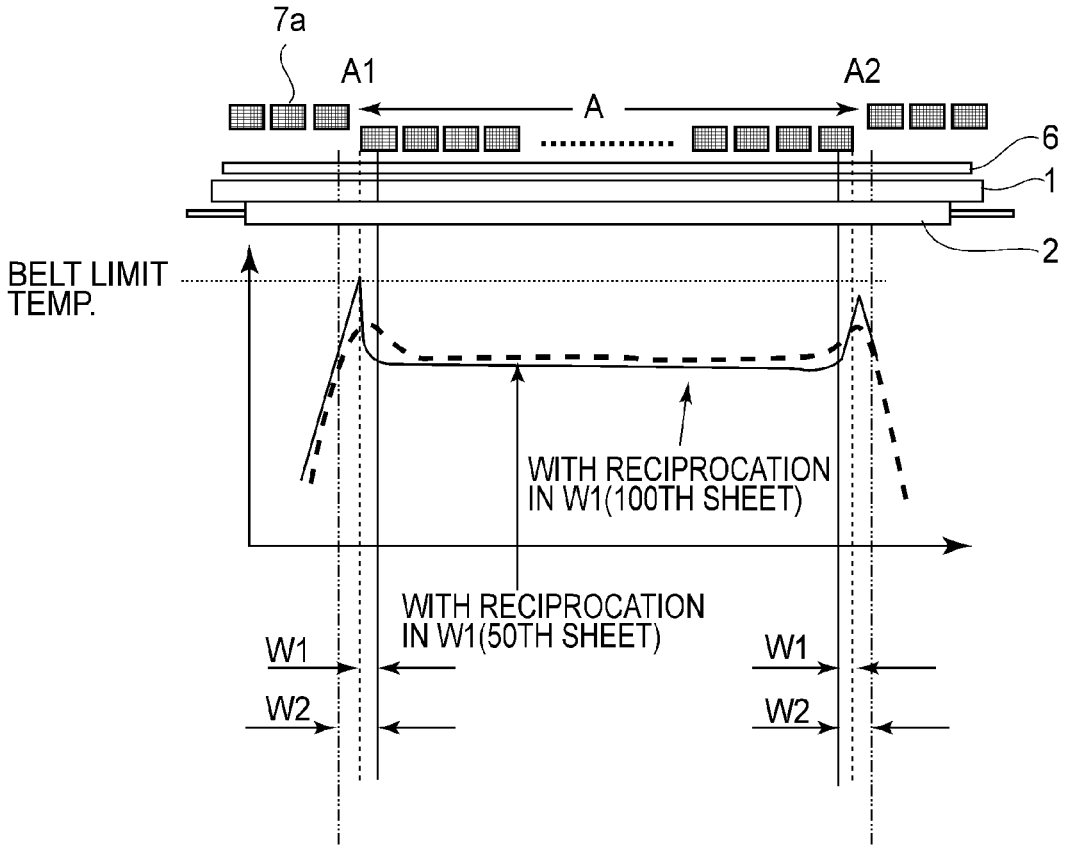

FIG. 12 is an illustration of the end portion temperature rise at the time of sheet passing of 100th sheet.

Figure 13:
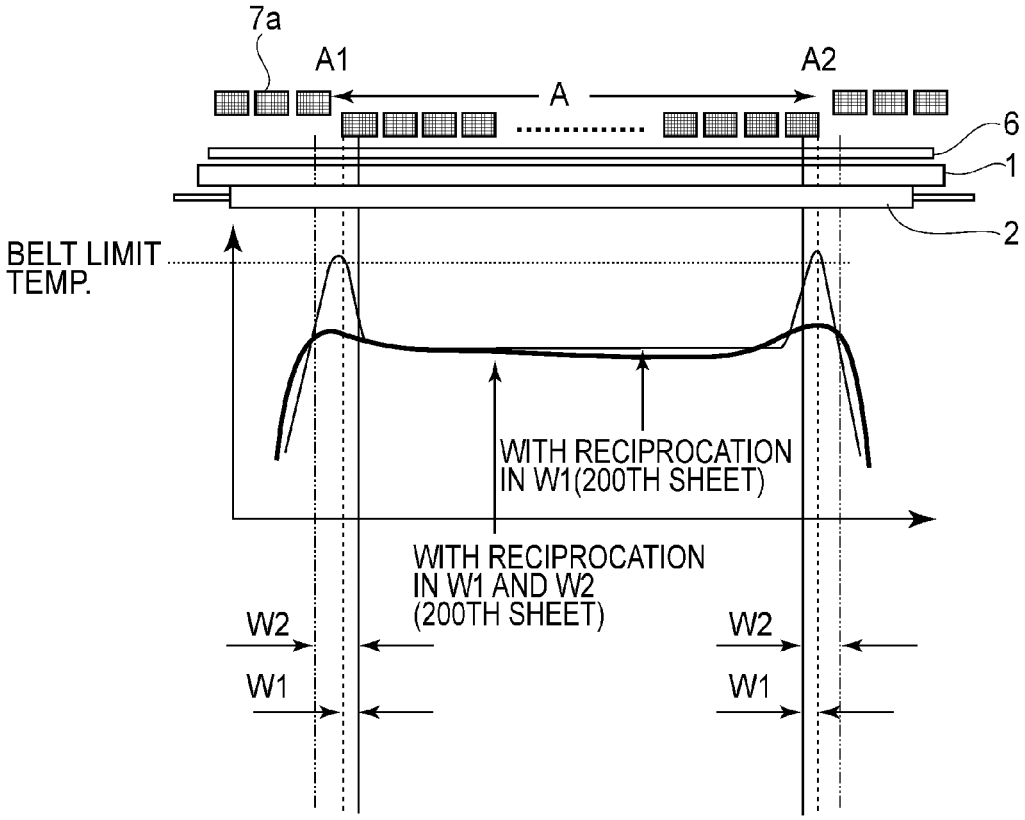

FIG. 13 is an illustration of the end portion temperature rise at the time of sheet passing of 200th sheet.

Figure 14:
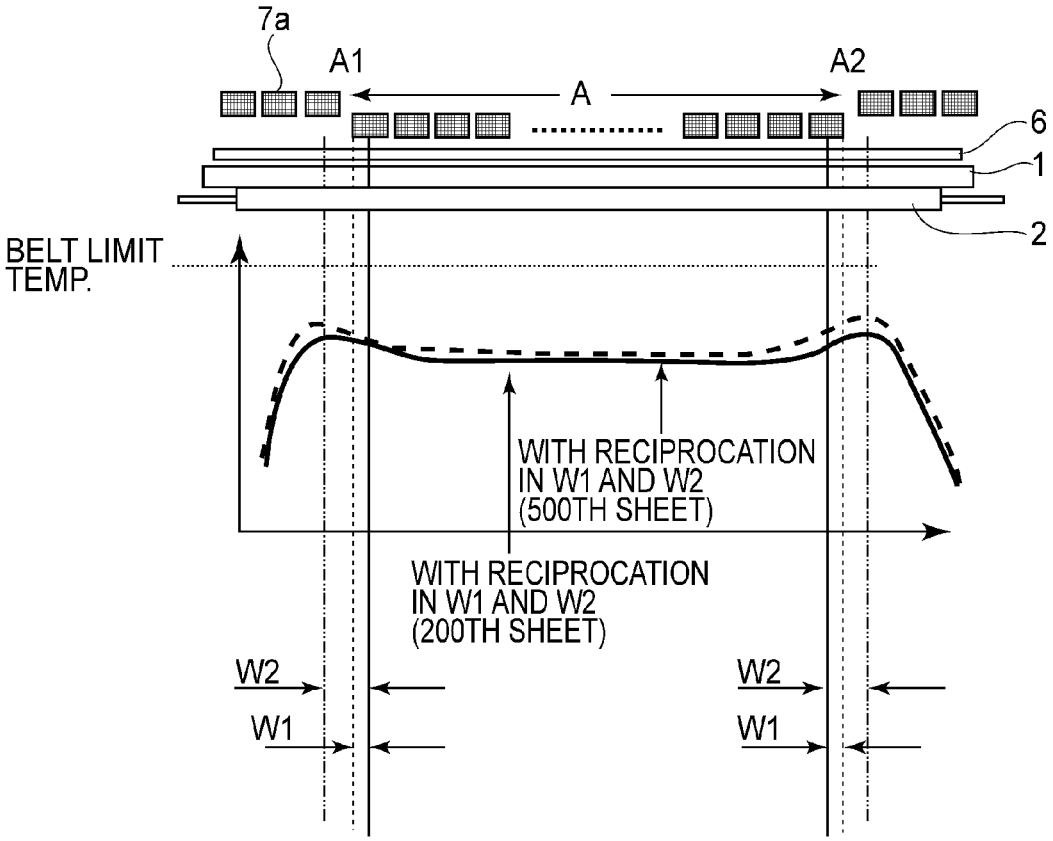

FIG. 14 is an illustration of the end portion temperature rise at the time of sheet passing of 500th sheet.

Figure 15:
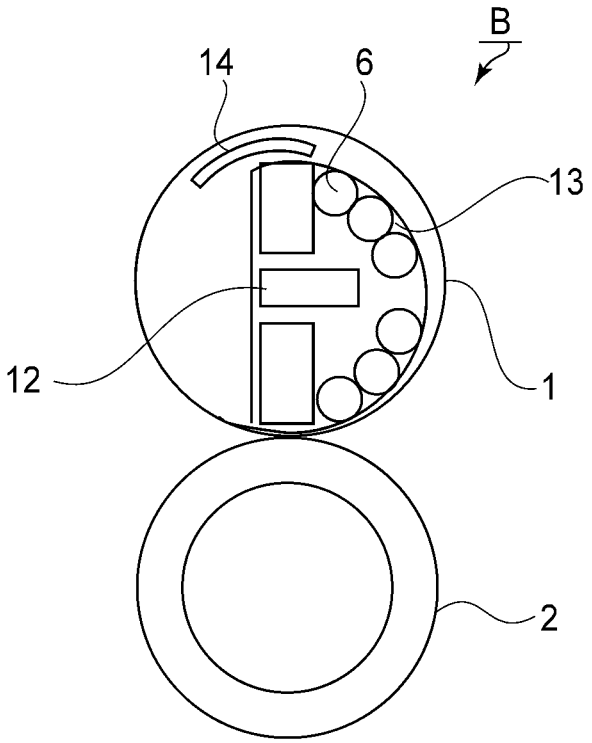
Figure 15:
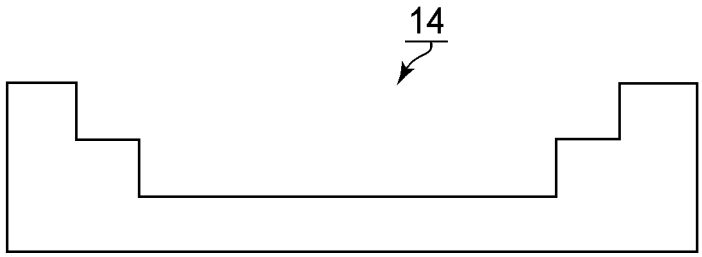

Parts (a) and (b) of FIG. 15 are illustrations of a structure of a fixing device in Embodiment 3.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a recording material (sheet) passing range in a fixing nip is gradually enlarged after a heating range of induction heating is set and then heating of a recording material is started.

Therefore, an image heating apparatus includes not only a fixing device for fixing a toner image on a recording material by heating the recording material on which the toner image is transferred but also a surface-treating device for providing a desired surface property to an image by heating a toner image which is partly fixed or completely fixed.

An image forming apparatus in which the image heating apparatus is mounted can be carried out in the present invention irrespective of the types of monochromatic/full-color, sheet-feeding/recording material conveyance/intermediary transfer, a toner image forming method and a transfer method if in an image forming apparatus, a toner image is fixed on a recording material, on which the toner image is transferred, is heated and pressed.

In the following embodiments, only a principal portion concerning formation/transfer/fixing of the toner image will be described but the present invention can be carried out in image forming apparatuses with various uses including printers, various printing machines, copying machines, facsimile machines, multi-function machines, and so on by adding necessary equipment, options, or casing structures.

<Image Forming Apparatus>

Figure 1:
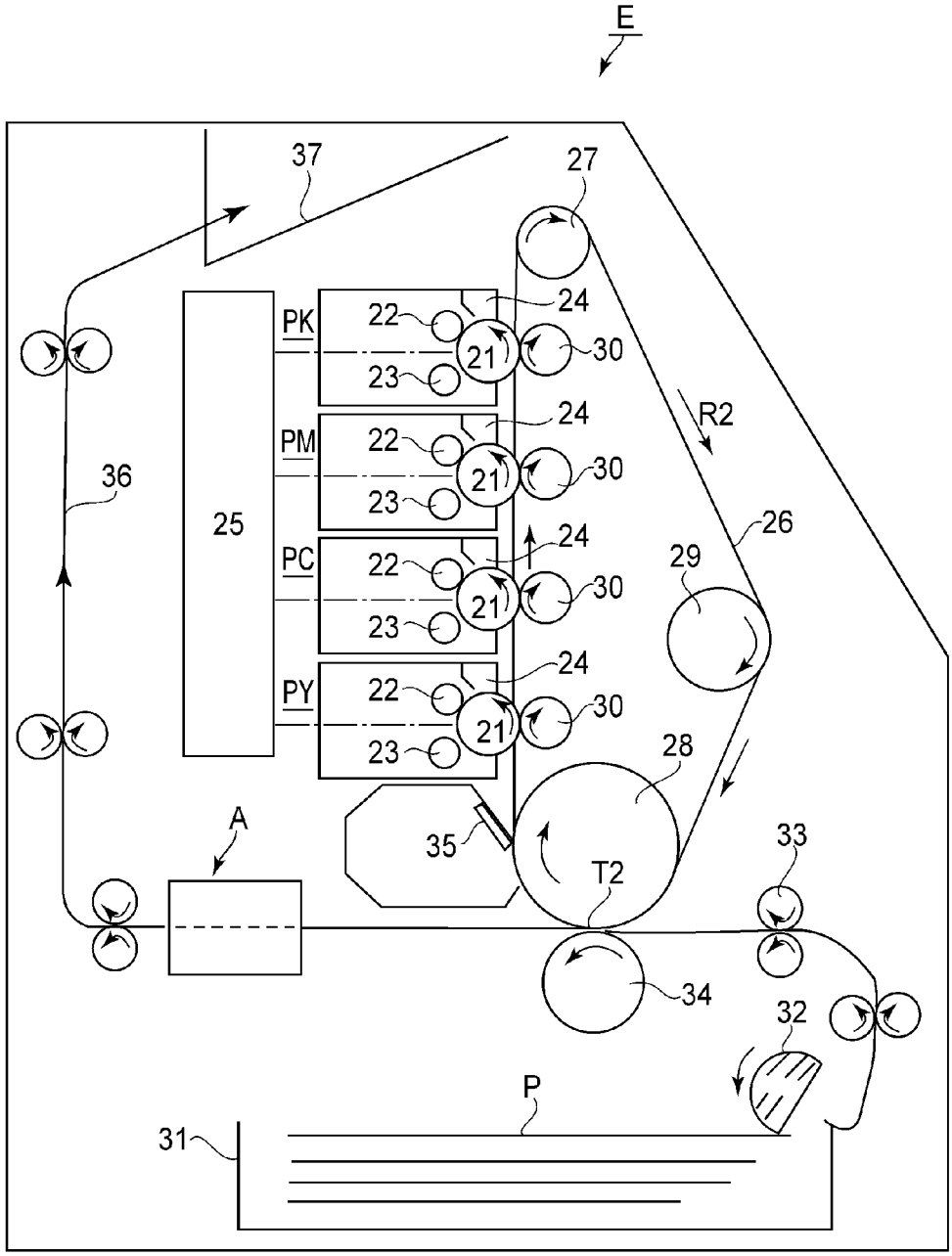
FIG. 1 is an illustration of a structure of an image forming apparatus.

FIG. 1 is an illustration of structure of an image forming apparatus.

As shown in FIG. 1, an image forming apparatus E in this embodiment is a tandem-type full-color printer of an intermediary transfer type in which image forming portions PY, PM, PC and PK for yellow, magenta, cyan and black, respectively, are arranged along an intermediary transfer belt 26.

In the image forming portion PY, a yellow toner image is formed on a photosensitive drum 21(Y) and then is primary-transferred onto the intermediary transfer belt 26. In the image forming portion PM, a magenta toner image is formed on a photosensitive drum 21(M) and is primary-transferred superposedly onto the yellow toner image on the intermediary transfer belt 26. In the image forming portions PC and PK, a cyan toner image and a black toner image are formed on photosensitive drums 21(C) and 21(K), respectively, and are successively primary-transferred superposedly onto the intermediary transfer belt 26.

The intermediary transfer belt 26 uses an endless resin belt and is stretched around three rollers consisting of a driving roller 27, a secondary transfer opposite roller 28 and a tension roller 26, and is driven by the driving roller 26.

A recording material P is pulled out from a recording material cassette 31 one by one by a sheet feeding roller 32 and awaits between registration rollers 33.

The recording material P is sent by the registration rollers 33 toward a secondary transfer portion T2 while being timed to the toner images on the intermediary transfer belt 26, the toner images are secondary-transferred from the intermediary transfer belt 26 onto the recording material P. The recording material P on which the four color toner images are secondary-transferred is conveyed into a fixing device A is, after being heated and pressed by the fixing device A to fix the toner images thereon, discharged onto an external tray 36 by a discharging mechanism 36.

The image forming portions PY, PM, PC and PK have the substantially same constitution except that the colors of toners of yellow, cyan, magenta and black used in developing devices 23(Y), 23(M), 23(C) and 23(K) are different from each other. In the following description, the yellow image forming portion PY will be described and other image forming portions PM, PC and PK will be omitted from redundant description.

The image forming station PY includes the photosensitive drum 21 around which a charging roller 22, an exposure device 25, the developing device 23, a primary transfer roller 30, and a drum cleaning device 24 are disposed.

The charging roller 22 electrically charges the surface of the photosensitive drum 21 to a uniform potential. The exposure device 25 writes (forms) an electrostatic image for an image on the photosensitive drum 21 by scanning with a laser beam. The developing device 23 develops the electrostatic image to form the toner image on the photosensitive drum 21. The primary transfer roller 30 is supplied with a voltage, so that the toner image on the photosensitive drum 21 is primary-transferred onto the intermediary transfer belt 26.

In the image forming apparatus E for effecting image formation by the electrophotographic process, the fixing device A for heat-melting the unfixed toner image transferred onto the conveyed recording material to fix the toner image on the recording material is provided.

<Image Heating Apparatus>

Figure 2:
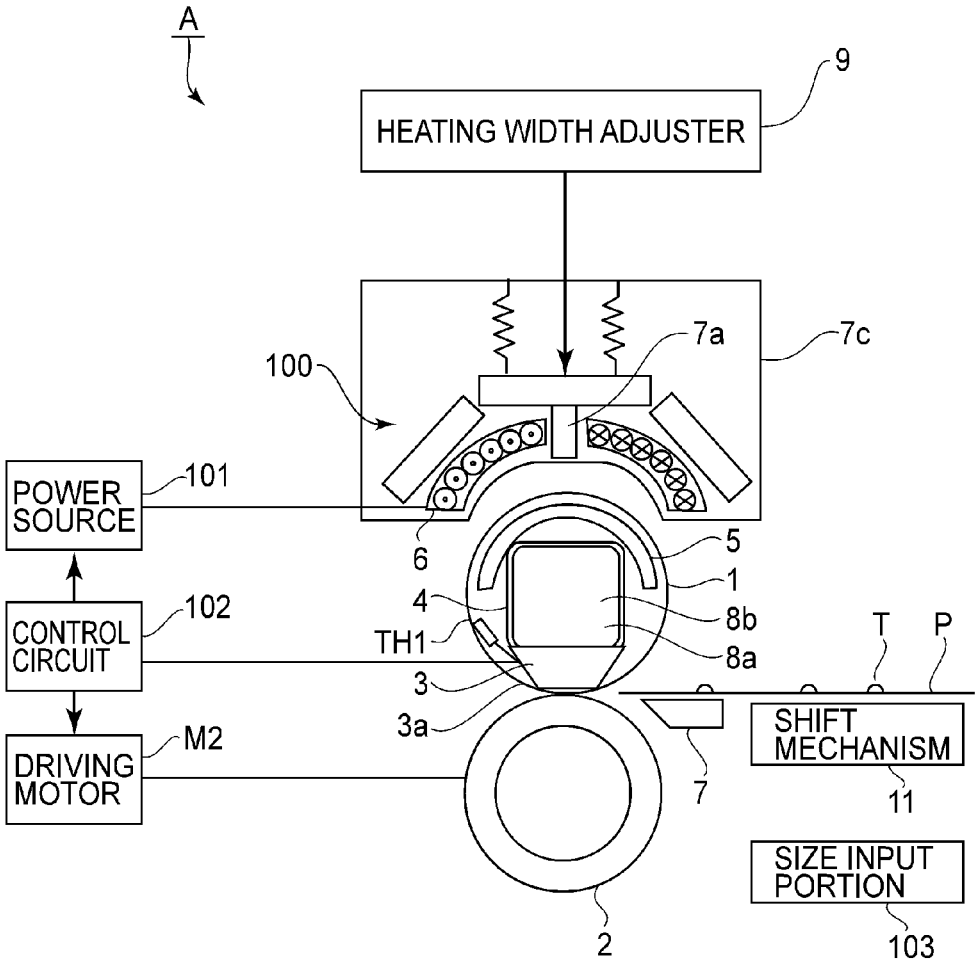
FIG. 2 is an illustration of a structure of a principal portion of a fixing device (image heating apparatus).

FIG. 2 is an illustration of a structure of a principal portion of the fixing device. In the following description, with respect to the fixing device or members constituting the fixing device, a longitudinal direction refers to a direction parallel to a direction perpendicular to a recording material conveyance direction in a plane of a recording material conveyance path. Further, a widthwise direction refers to a direction parallel to the recording material conveyance direction. With respect to the fixing device, a front surface refers to a surface as seen from a recording material entrance side with respect to the recording material conveyance direction, and a rear surface is a surface (a recording material exit side) opposite from the front surface. The left (side) and the right (side) refer to left (side) and right (side) as seen from the front surface side. An upstream side and a downstream side refer to an upstream side and a downstream side with respect to the recording material conveyance direction.

As shown in FIG. 2, a heating belt 1 which is an example of an image heating member has a metal layer to be subjected to induction heating and is rotated while being supported at its inner surface. A pressing roller 2 which is an example of a rotatable pressing member has an elastic layer and is contacted to another surface of the heating belt 1 to form a heating nip N between itself and the heating belt 1. A supporting member 3 extends inside the heating belt 1 and is disposed non-rotatably, and supports the inner surface of the heating belt 1 at an opposing position to the pressing roller 2.

The fixing belt (heating belt) 1 of the fixing device A is an endless heating belt member having the metal layer. The pressing roller 2 is press-contacted to the outer surface of the fixing belt 1 supported by the supporting member 3 at its inner surface, thus forming the heating nip N for the recording material P between itself and the fixing belt 1. The fixing belt 1 is rotationally driven, by rotationally driving the pressing roller 2 by a motor M2 controlled by a control circuit portion 102, at the substantially same peripheral speed as a conveyance speed of the recording material P conveyed from the secondary transfer portion T2 in FIG. 1. The fixing device A is capable of continuously fixing sheets of the recording material P at a surface rotational speed of 300 mm/sec, thus fixing a full-color image on the recording material at 80 sheets/min for A4-size landscape feeding and at 58 sheets/min for A4-size portrait feeding.

The recording material P is hermetically contacted to the outer peripheral surface of the fixing belt 1 in the heating nip N and is nip-conveyed in the heating nip N together with the fixing belt 1. The unfixed toner image T is supplied with the pressure under application of heat in the heating nip N, thus being fixed on the surface of the recording material P. The recording material P having passed through the heating nip N is self-separated from the outer peripheral surface of the fixing belt 1 since the surface of the fixing belt 1 is deformed at an exit portion of the heating nip N, and then is conveyed to the outside of the fixing device A.

<Pressure-Applying Member>

Figure 3:
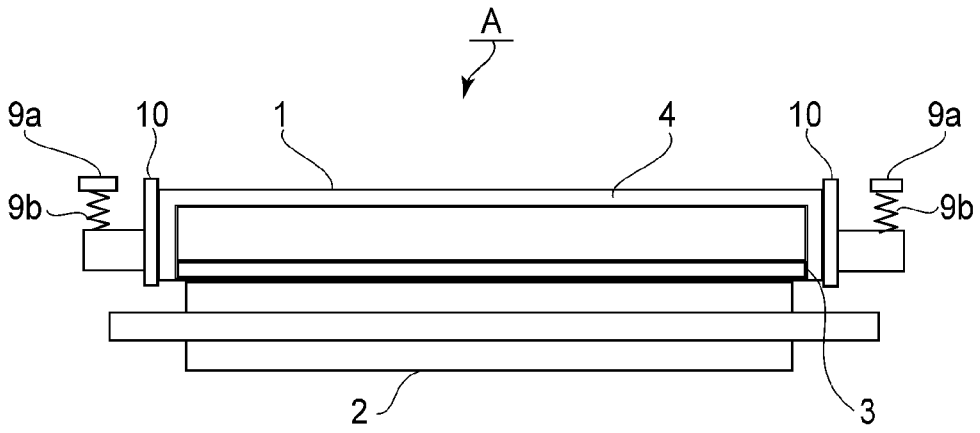
FIG. 3 is an illustration of a structure of the fixing device with respect to a longitudinal direction.

FIG. 3 is an illustration of a structure of the fixing device with respect to a longitudinal direction. As shown in FIG. 3, fixing flanges 10 are left and right preventing member (regulating member) for preventing (regulating) longitudinal movement of and circumferential shape of the fixing belt 1 are provided. A base layer of the rotating fixing belt 1 is formed of metal and therefore even in the rotation state, as a means for preventing deviation (shift) in a widthwise direction, provision of the fixing flanges only for simply receiving the end portions of the fixing belt 1 suffice. As a result, there is the advantage such that the constitution of the fixing device can be simplified.

A stay 4 and a supporting member 3 are fixed at their end portions by the fixing flanges 10 and extend the inside of the fixing belt 1, and are disposed non-rotatably. The supporting member 3 is formed of a heat-resistant resin material and is a pressure-applying member which applies the pressure between the fixing belt 1 and the pressing roller 2 to form the heating nip N and is held over full length in a beam-like shape by the metal stay 4.

The stay 4 requires rigidity in order to apply the pressure to the heating nip N and therefore is formed of iron in this embodiment. A stay-pressing spring 9*b* is compressedly provided between each end portion of the stay 4 inserted and provided in the fixing flange 10 and a spring-receiving portion 9*a* provided at a casing side of the fixing device A. The stay-pressing spring 9*b* applies a pressing-down force to the stay 4 to press-contact the lower surface of the supporting member 3 and the upper surface of the pressing roller 2 to the fixing belt 1, thus forming the heating nip N.

<Induction Heating Apparatus>

As shown in FIG. 2, inside the fixing belt 1, a magnetic-shielding core 5 as a magnetic circuit member for guiding magnetic flux which is emitted from the outside magnetic core 7*a* and penetrates through the fixing belt 1 is provided. The magnetic-shielding core 5 also functions as a magnetic-shielding member for preventing temperature rise of the stay 4 or the like by the induction heating. The supporting member 3 is close to an exciting coil 6 particularly at its end portions, and at its upper surface, the magnetic-shielding core 5 is disposed over the longitudinal direction in order to shield the magnetic field generated in the exciting coil 6 so as to prevent the heat generation of the supporting member 3. The induction heating apparatus 100 is a heating source for induction-heating the fixing belt 1 by causing an AC magnetic field to action the fixing belt 1 through the outside magnetic core 7*a*. The induction heating apparatus 100 is provided oppositely to the fixing belt 1 with a predetermined gap (spacing) at an upper side of the outer peripheral surface of the fixing belt 1.

The exciting coil 6 uses Litz wire as an electric wire and is prepared by winding Litz wire in an elongated ship bottom shape so as to oppose a part of the peripheral surface and side surface of the fixing belt 1. The outside magnetic core 7*a* is disposed to cover the exciting coil 6 so that the magnetic field generated by the exciting coil 6 is not substantially leaked from the metal layer (electroconductive layer) of the fixing belt 1.

In this embodiment as shown in (a) and (b) of a rotational state of the fixing belt 1, to the exciting coil 6 of the induction heating apparatus 100, a high-frequency current of 20-50 kHz is applied from a power supply apparatus (exciting circuit) 101. By the magnetic field generated by the exciting coil 6, the metal layer (electroconductive layer) of the fixing belt 1 is subjected to the induction heating.

A temperature sensor TH1 is a temperature detecting element such as a thermistor for detecting the temperature of the fixing belt 1 at a substantially center portion of a sheet passing width of the recording material. The temperature sensor TH1 is mounted from the supporting member 3 via an elastic supporting member and follows positional fluctuation to keep a good contact state even when the positional fluctuation such as waving of the contact surface of the fixing belt 1. Detected temperature information of the temperature sensor TH1 is fed back to electric power inputted into the exciting coil 6.

The control circuit portion 102 controls the electric power inputted from the power supply apparatus 101 into the exciting coil 6 so that the detected temperature inputted from the temperature sensor TH1 is kept at a predetermined target temperature (fixing temperature). The control circuit portion 102 controls, on the basis of a detection value of the temperature sensor TH1, the electric power to be inputted into the exciting coil 6 by changing the frequency of the high-frequency current so that the detected fixing belt temperature is constant at 180° C. In the case where the detected temperature of the fixing belt 1 is increased to 200° C. which is an upper limit, energization to the exciting coil 6 is blocked.

When an image forming job is received, the control circuit portion 102 starts electric power supply from the power supply apparatus 101 to the exciting coil 6 of the induction heating apparatus 100. When the fixing belt 1 is increased in temperature up to a predetermined fixing temperature and is placed in a temperature-controlled state, the control circuit portion 102 starts the image formation. As a result, the recording material P carrying thereon the unfixed toner image T is guided by a guide member 7 with the toner image carrying surface directed toward the fixing belt 1, thus being introduced into the heating nip N.

In the fixing device A, the induction heating apparatus 100 including the exciting coil 6 is not disposed inside the fixing belt 1 to be heated to the high temperature but is disposed outside the fixing belt 1. For this reason, the temperature of the exciting coil 6 does not tend to become the high temperature, so that the electric resistance is also not increased and thus it is possible to alleviate loss due to the Joule heat generation even when the high-frequency current is passed through the exciting coil 6. Further, the exciting coil 6 disposed outside the fixing belt 1 also contributes to a small diameter (low thermal capacity) of the fixing belt 1, thus being consequently excellent in energy saving property.

With respect to the warming-up time of the fixing device A during actuation, the constitution in which the thermal capacity is very low is employed and therefore when e.g., 1200 W is inputted into the exciting coil 6, the fixing belt temperature can reach 160° C., which is the target temperature, in about 15 sec. For this reason, a heating operation during stand-by is not needed and therefore electric power consumption can be suppressed at a very low level.

<Heating Belt Member>

Figure 4:
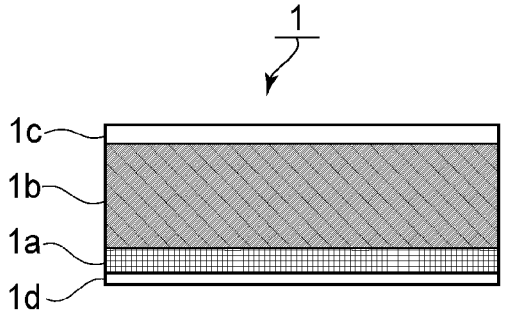
FIG. 4 is a schematic view showing a layer structure of a fixing belt.

FIG. 4 is a schematic view showing a layer structure of the fixing belt 1. As shown in FIG. 4, the fixing belt 1 has an inner diameter of 30 mm and includes a base layer (metal layer) 1*a* of nickel which is manufactured through electroforming, thus being rotatable. The base layer 1*a* has a thickness of 40 μm.

At an outer peripheral surface of the base layer 1*a*, a heat-resistant silicone rubber layer is provided as an elastic layer 1*b*. The thickness of this silicone rubber layer may preferably be set within a range from 100 μm to 1000 μm. In the fixing device A, the thickness of the silicone rubber layer 1*b* is set at 300 μm in consideration that thermal capacity of the fixing belt 1 is decreased to shorten a warming-up time and a suitable fixation image is obtained during the fixation of the color images. The material for the silicone rubber layer has a JIS-A hardness of 20 degrees and a thermal conductivity of 0.8 W/mK.

Further, at an outer peripheral surface of the elastic layer 1*b*, a fluorine-containing resin material layer (e.g., of PFA or PTFE) as a surface parting layer 1*c* is provided in a thickness of 30 μm.

On an inner surface side of the base layer 1*a*, in order to lower sliding friction between the inner surface of the fixing belt 1 and the temperature sensor TH1, a resin material layer (lubricating layer) 1*d* may be formed of a fluorine-containing resin material or polyimide in a thickness of 10-50 μm. In the fixing device A, as the resin material layer 1*d*, a 20 μm-thick polyimide layer is provided.

As a material for the metal (base) layer 1*a* of the fixing belt 1, in addition to nickel, an iron alloy, copper, silver or the like is appropriately selectable. Further, the metal layer 1*a* may also be constituted so that a layer of the metal or metal alloy described above is laminated on a resin material base layer. The thickness of the metal layer may be adjusted depending on a frequency of a high-frequency current caused to flow through the exciting coil described later and depending on magnetic permeability and electrical conductivity of the metal layer and may be set in a range from 5 μm to 200 μm.

<Pressing Roller>

As shown in FIG. 2, a mold member 7*c* integrally supports the outside magnetic core 7*a* and the exciting coil 6 by an electrically insulating resin material. However, a part of the outside magnetic core 7*a* is supported so that its opposing distance from the fixing belt 1 is changeable.

The fixing belt 1 and the exciting coil 6 of the induction heating apparatus 100 are kept in the electrically insulating state by a 0.5 mm-thick mold, and a distance between the fixing belt 1 and the exciting coil is constant at 1.5 mm (distance between the mold surface and the fixing belt surface: 1.0 mm), so that the fixing belt 1 is uniformly heated.

The pressing roller 2 has an outer diameter of 30 mm and including an iron-made core metal 2*a* having a central portion diameter of 20 mm and both end portion diameters of 19 mm with respect to the longitudinal direction, a silicone rubber layer as an elastic layer 2*b*, and a 30 μm-thick surface parting layer 2*c* of a fluorine-containing resin material layer (e.g., PFA or PTFE). The pressing roller 2 has an ASKER-C hardness (JIS) of 70 degrees at the central portion with respect to the longitudinal direction. The core metal 2*a* has a tapered shape. This is because the pressure in the heating nip N between the fixing belt 1 and the pressing roller 2 is uniformized over the longitudinal direction even in the case where the supporting (pressure-applying) member 3 is bent when the pressing roller 2 presses the fixing belt 1.

The width of the heating nip N of the fixing device A with respect to the rotational direction of the pressing roller 2 is about 9 mm at the both end portions of the pressing roller 2 and about 8.5 mm at the central portion of the pressing roller 2 with respect to the longitudinal direction of the pressing roller 2 under application of nip pressure of 600 N. This constitution has the advantage such that a conveyance speed of the recording material P at the both end portions is higher than that at the central portion with respect to the widthwise direction of the recording material conveyance, thereby to less cause an occurrence of a crease of paper.

<Heating Width Adjusting Mechanism>

Figure 5:
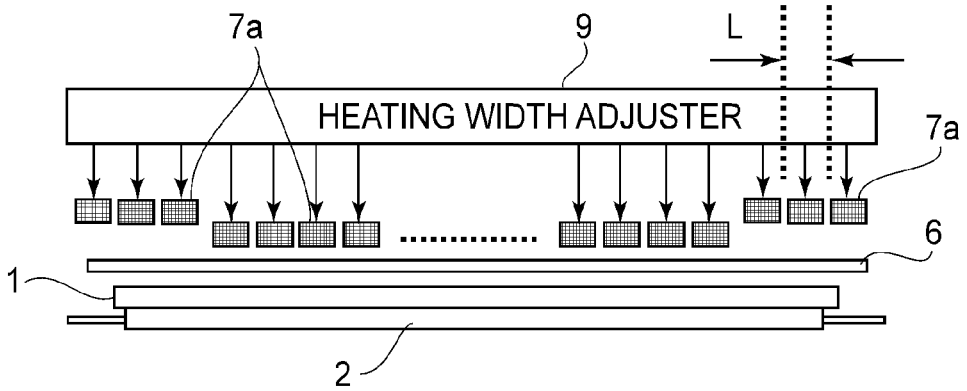
FIG. 5 is an illustration of an arrangement of an outside magnetic core.

FIG. 5 is an illustration of an arrangement of the outside magnetic core. FIG. 6 is an illustration of an operation of the outside magnetic core.

As shown in FIG. 2, the induction heating apparatus 100 which is an example of the AC magnetic field generating means can generate AC magnetic flux for subjecting the metal layer to the induction heating and also can set a heating width at a plurality of levels, with respect to the widthwise direction of the fixing belt 1, depending on the recording material size.

The outside magnetic core 7*a* which is an example of the core member is provided is a plurality of outside magnetic cores 7*a* arranged in the widthwise direction. The exciting coil 6 which is an example of the coil member generates the magnetic flux in the plurality of outside magnetic cores 7*a*.

The outside magnetic member 7*e* magnetically communicates with the plurality of outside magnetic cores 7*a* at the opposite side of the fixing belt 1.

The plurality of outside magnetic cores 7*a*, the exciting coil 6 and the outside magnetic member 7*e* are disposed outside the heating belt (fixing belt) 1. The magnetic-shielding core 5 which is an example of an inside magnetic member is disposed inside the heating belt 1 and magnetically communicates with the plurality of outside magnetic cores 7*a* at the inside of the heating belt 1.

The heating width adjusting mechanism 9 which is an example of an adjusting means controls a magnetic circuit of the magnetic flux which is emitted from the outside magnetic cores 7*a* and penetrates through the fixing belt 1. The heating width adjusting mechanism 9 sets a magnetic reluctance of the magnetic circuit of the magnetic flux of the outside magnetic core 7*a* within a range corresponding to the recording material size at a value smaller than that outside the range, thus setting the heating width at a plurality of levels.

The mold member 7*c* a mold member 7*c* integrally supports the outside magnetic core 7*a* and the exciting coil 6 by an electrically insulating resin material. However, a part of the outside magnetic core 7*a* is supported so that its opposing distance from the fixing belt 1 is changeable.

As shown in FIG. 5, the outside magnetic cores 7*a* are divided portions with respect to the longitudinal direction of the fixing belt 1, and each of the outside magnetic cores 7*a* is disposed at an interval (10 mm in this embodiment) including play for movement.

The heating width adjusting mechanism 9 is capable of setting the gap (spacing) between the outside magnetic core 7*a* and the fixing belt at two levels, consisting of a close level and a distance level, by moving each of the outside magnetic cores 7*a* in a vertical direction. As a specific constitution of the heating width adjusting mechanism 9, a mechanism in which a pair of sliders each provided with an inclined surface at an end portion is moved along the mold member 7*c* in the longitudinal direction and the outside magnetic cores 7*a* which are urged by springs are individually pressed upward was employed.

As shown in (a) of FIG. 6, in a region corresponding to the recording material conveyance width, the fixing belt 1 and the exciting coil 6 of the induction heating apparatus 100 are kept in the electrically insulating state by a 0.5 mm-thick mold layer, and a distance between the mold layer surface and the fixing belt surface is 1.0 mm. For this reason, the distance between the fixing belt 1 and the exciting coil 6 is constant at 1.5 mm, so that the fixing belt 1 is uniformly heated. In the region corresponding to the conveyance width of the recording material P, the gap between the exciting coil 6 and the outside magnetic core 7*a* is 0.5 mm, i.e., these members are close to each other, so that a heat generating efficiency is very high.

As shown in (b) of FIG. 6, the control circuit portion 102 reads a recording material input value after receiving a print job and actuates the heating width adjusting mechanism 9 so that the heating width suitable for the recording material size can be obtained. In a region corresponding to the outside of the conveyance width of the recording material P, the gap between the exciting coil 6 and the outside magnetic core 7*a* is increased, by moving the outside magnetic core 7*a*, to lower the heat generating efficiency. In this embodiment, the distance of movement is 10 mm. By increasing the gap between the exciting coil 6 and the outside magnetic core 7*a*, a density of the magnetic flux passing through the fixing belt 1 is reduced, so that the heat generating amount of the fixing belt 1 is lowered.

In the image heating apparatus A, in order to realize high-speed temperature rise, the fixing belt 1 is heated by the induction heating. Thus, the thermal capacity of a heating medium is decreased and is intended to be heated by a heat source with a good heating efficiency. Further, from the viewpoints of cost and energy efficiency, in the image forming apparatus E, the image heating apparatus of the type in which the toner image on the recording material is heat-melted by bringing the thin heating medium into contact with the recording material is mounted.

However, in the case where the thin heating medium is used as the heating medium in order to decrease the thermal capacity, a cross-sectional area of a cross section perpendicular to an axis of the heating medium is very small and therefore a heat transfer efficiency with respect to an axial direction is not good. This tendency is conspicuous with a smaller thickness of the heating medium, and is further conspicuous for a resin material layer with a low thermal conductivity.

This is also clear from the Fourier's law such that a heat quantity Q transmitted per unit time is, when the thermal conductivity is λ, a temperature difference between two point is θ1−θ2 and a length between the two points is L, represented by the following formula:

$$Q=\lambda\times f(\theta 1-\theta 2)/L.$$

This is not so problematic in the case where the recording material with a maximum sheet passing width is subjected to sheet passing and fixing. However, in the case where a small-sized recording material with a narrow width is continuously subjected to sheet passing, the temperature of the heating medium in a non-sheet passing region was increased to a value higher than a target (control) temperature to result in a large difference between the temperature in a sheet passing region and the temperature in the non-sheet passing region.

Therefore, due to such temperature non-uniformity of the heating medium, there is a possibility that a heat lifetime of a peripheral member of a resin material is lowered and that the peripheral member is thermally damaged.

Further, paper crease, skew and the like and fixing non-uniformity can also occur due to partial temperature non-uniformity when a large-sized recording material is subjected to sheet passing immediately after the continuous sheet passing of the small-sized recording material. Such a temperature difference between the sheet passing region and the non-sheet passing region is widen with a larger thermal capacity of the recording material to be conveyed and with a higher throughput (print number per unit time). For this reason, with respect to the image heating apparatus using by the thin heating medium with low thermal capacity, it was difficult to apply the image heating apparatus to a copying machine with the high throughput.

Therefore, in the fixing device A, between the heating medium and the induction heating source, the magnetic-shielding means for partly shielding the magnetic flux sent from the induction heating source to the heating medium is disposed and a displacing means for changing the position of the magnetic-shielding means is also provided. By providing and moving the magnetic-shielding means, the magnetic flux sent from the induction heating source is shielded at a portion other than a necessary portion to suppress the heat generation itself, so that control of a heat generation range is effected and thus it becomes possible to control a heat distribution of the heating medium to be increased in temperature.

However, even when the heat distribution of the heating medium is controlled, the position of the divided magnetic cores with respect to the direction perpendicular to the recording material conveyance direction does not coincide with the position of the recording material, so that the temperature rise occurs in the non-sheet passing region when the heating region is wider than the recording material.

Further, even when the position of the divided magnetic cored with respect to the direction perpendicular to the recording material conveyance direction coincides with the position of the recording material, the temperature rise occurs at both end portions (edge portions) of the recording material.

This is because the heat generation amount sufficient for fixing the toner is also required at the end portions of the recording material, but the sheet passing, compared with the sheet passing region, the heat quantity taken by the recording material is small at the recording material end portions and thus the temperature is excessively increased.

After the heating of the recording material P is started, the high-temperature region is moved toward the outside of the pressing roller 2 with respect to the longitudinal direction, so that the excessive temperature rise occurs also at the outside of the heating width of the fixing belt 1 contacted to the pressing roller 2. The surface of the recording material P is instantaneously heated to 100° C. or more and therefore the surface of the fixing belt 1 is heated to 160° C. so that the metal layer of the fixing belt 1 subjected to the induction heating becomes high temperature close to 200° C. In the sheet passing region, the temperature of the pressing roller 2 is lowered and therefore a temperature peak is created at an adjacent portion outside the sheet passing region. Further, at the adjacent portion outside the sheet passing region the heat is moved in the longitudinal direction of the fixing belt 1 through the metal layer in a state in which the fixing belt 1 is sandwiched between the high-temperature supporting member 3 and the high-temperature pressing roller 2 and therefore the excessive temperature rise occurs.

This phenomenon is more conspicuous in the constitution using the low-thermal-capacity belt. Therefore, in the following embodiments, the fixing belt or the recording material is reciprocated in the direction perpendicular to the recording material conveyance direction, so that a degree of the temperature rise at the non-sheet passing portion (region) or the recording material end portions is decreased and thus durability of the fixing belt is improved.

<Recording Material Shift Mechanism>

FIG. 7 is an illustration of the recording material shift mechanism as a changing means. As shown in FIG. 2, a recording material shift(ing) mechanism 11 shifts a relative positional relationship, between the heating nip N and the recording material P conveyed into the heating nip N, in the longitudinal direction. Here, a mechanism for horizontally moving the recording material P in the widthwise direction at the position in front of the fixing device A.

As shown in FIG. 7, a recording material leading end sensor 11*a* detects the recording material, thus detecting conveyance of the recording material P. A recording material end portion position sensor 11*c* detects an end portion position of the conveyed recording material P. The recording material shift mechanism 11 shifts the recording material P in the direction perpendicular to the conveyance direction of the recording material P, so that the recording material P is conveyed to a desired position with respect to the widthwise direction of the fixing belt 1. The recording material shift mechanism 11 changes an angle 11*g* of a conveying roller 11*b* contacted to the lower surface of the recording material P, so that the recording material P is shifted in the widthwise direction. Guides 11*e* and 11*f* are contacted to edges of the recording material with respect to the widthwise direction to regulate the position of the recording material with respect to the widthwise direction.

Embodiment 1

FIG. 8 is a flow chart of sheet passing control in Embodiment 1. As shown in FIG. 2, the recording material shift mechanism 11 which is an example of a reciprocating mechanism reciprocates a sheet passing position of the recording material P in the heating nip N in the widthwise direction, so that an sheet passing range of the recording material in the heating nip N is extendable.

The control circuit portion 102 which is a control means actuates the induction heating apparatus 100 to start the heating of the recording material with a heating width corresponding to the recording material size. Thereafter, the recording material shift mechanism 11 is controlled so that the sheet passing range of the recording material is extended depending on a cumulative member of heated sheets of the recording material.

The control circuit portion 102 stepwisely extends the sheet passing range of the recording material so that the sheet passing range follows enlargement of a temperature region, in which the recording material is heatable, formed in the heating nip N after the actuation of the induction heating apparatus 100.

The control circuit portion 102 sets the heating width smaller than a length of the recording material P with respect to the widthwise direction by the heating width adjusting mechanism 9 and then starts the heating of the recording material P. Thereafter, when the cumulative number of heated sheets reaches a first cumulative number of heated sheets varying depending on the type of the recording material P, the sheet passing range of the recording material is extended with an increment of one level which is smaller than the length of the outside magnetic core 7*a* with respect to the widthwise direction.

The control circuit portion 102 further extends the sheet passing range of the recording material P by one level when the cumulative number of heated sheets reaches a second cumulative number of heated sheets larger than the first cumulative number of heated sheets. As a result, the sheet passing range of the recording material P is moved to the outside of the heating width set by the heating width adjusting mechanism 9. That is, the control circuit portion 102 has the function as a switching means for switching the sheet passing range of the recording material.

In this embodiment, a degree of the excessive temperature rise of the fixing belt 1 occurring at the adjacent portion outside the sheet passing region (hereinafter, this adjacent portion is referred to as the recording material end portion) is reduced by reciprocating the recording material P in the widthwise direction.

As shown in FIG. 8 with reference to FIG. 2, the control circuit portion 102 obtains a recording material size inputted into the recording material size input portion 103 (S201).

The control circuit portion 102 moves, on the basis of the read inputted value, the outside magnetic cores 7*a* located at the non-sheet passing portions as shown in FIG. 5 (S202), so that a proper heating width for fixing the toner image on the recording material P is obtained.

As shown in FIG. 7, a region in which the magnetic flux density is enhanced by the outside magnetic cores 7*a* is taken as A and the width of the recording material P is taken as B. A left end of the region A is A1 and a right end of the region A is A2. An outside region outside each of the left end A1 and the right end A2 (i.e., outside the region A) is an end portion region of the fixing belt 1. A left end of the width B of the recording material P is B1 and a aright end of the width B is B2. A difference between A1 and B1 is a first region W1. An outwardly extended region of the first region W1 is a second region W2. The control circuit portion 102 sets the first region W1 and the second region W2 depending on the recording material size (S203).

The region A is set at a value wider than the width B when the center positions of the fixing belt 1 and the recording material P coincide with each other with respect to the longitudinal direction. The first region W1 is set, so as to satisfy a formulae below, by moving the outside magnetic cores 7*a* at the non-sheet passing portions. In this embodiment, L=10 mm.

$$0<W1<L$$

The control circuit portion 102 reads pitch widths d1 and d2 for the shift on the basis of the type of the recording material P, the number of sheets subjected to the sheet passing and a sheet interval (S204). The shift pitch widths d1 and d2 are set at larger values with an increase of the basis weight of the recording material P. This is because there is a need to set the temperature for temperature control at a high value in order to ensure image fixability and is specifically because when the pitch width is decreased, a degree of the temperature rise at the A2 side at the time of moving the recording material P toward the A1 side is increased. A margin for a durability limit temperature of the fixing belt is small and therefore the fixing belt temperature is close to the durability limit temperature at the A2 side.

In this embodiment, the fixing device A is designated so that the durability limit temperature is 230° C. and a durability sheet passing number is 500,000 sheets, but when the temperature of the fixing belt 1 exceeds the durability limit temperature, the durability sheet passing number is considerably lowered.

Next, the control circuit portion 102 reads a reciprocation start sheet number N1 of the recording material P in the first region W1 and a reciprocation start sheet number N2 of the recording material P in the second region W2 from the table (S205). The numbers N1 and N2 are determined in advance, on the basis of the type of the recording material P and the sheet feeding interval, from the sheet passing numbers in which the temperature of the recording material P at the end portion position does not exceed a predetermined temperature.

The control circuit portion 102 actuates, when the sheet passing number N after the start of the image formation is larger than the number N1 (YES of S206), the recording material shift mechanism 11 to start reciprocation of the recording material P within the first region W1 (S207).

Thereafter, when the image formation is continued, the temperature rise of the fixing belt 1 occurs at a position further outside the first region W1. For that reason, the control circuit portion 102 increases, when the sheet passing number N is larger than the number N2 (YES of S208), the reciprocation region of the recording material P to extend the reciprocation range to the second region W2 (S209). When the sheet passing number exceeds a predetermined number N2, the recording material P is reciprocated in the second region W2 with a predetermined shift pitch width d2.

In the reciprocation range in the second region W2, the temperature is not less than that in the sheet passing region and an image equivalent to that in the sheet passing region can be obtained. The second region W2 is set in advance on the basis of the type of the recording material P and th sheet feeding material (S203). The pitch width d2 is also, similarly as in the pitch width d1, determined in advance on the basis of the type of the recording material P, the sheet passing number and the sheet feeding interval (S204).

Incidentally, also in the case where the region A in which the magnetic flux density is enhanced by the outside magnetic cores 7*a* and the width B of the recording material P coincide with each other, similarly as in the case of FIG. 7, when the image formation is continued, the temperature rise is observed at a position outside the width B of the recording material P. This is because also in a region outside the region A in which the magnetic flux density is enhanced by the outside magnetic cores 7*a*, the heat generation amount itself of the fixing belt 1 is small but the temperature rise also occurs with an increase of the sheet passing number N in combination with the temperature rise of the pressing roller 2. In this case, when the temperature of the recording material P at the non-sheet passing portion is increased by the increasing sheet passing number N, the reciprocation of the recording material P is started from the second region W2 in which a fixed image equivalent to that in the sheet passing region can be obtained, so that the degree of the temperature rise at the non-sheet passing portion is reduced.

Embodiment 2

FIG. 9 is an illustration of end portion temperature rise in the case where a recording material is not reciprocated. FIG. 10 is an illustration of timing of reciprocation of the recording material. FIG. 11 is an illustration of the end portion temperature rise at the time of sheet passing of 50th sheet in the case where the recording material is reciprocated. FIG. 12 is an illustration of the end portion temperature rise at the time of sheet passing of 100th sheet. FIG. 13 is an illustration of the end portion temperature rise at the time of sheet passing of 200th sheet. FIG. 14 is an illustration of the end portion temperature rise at the time of sheet passing of 500th sheet.

In this embodiment, a specific example of the constitution and control in Embodiment 1 will be described. In this embodiment, the peripheral speed of the fixing belt 1 is 300 mm/sec, and the full-color image is fixed on the A4-sized sheets (landscape feeding, longitudinal width=210 mm) at a rate of 58 sheets per minute. Each of the outside magnetic cores 7*a* has a width of 10 mm and therefore the first region W1 in which the reciprocation is made is 5 mm. To the exciting coil 6, a maximum electric power of 1500 W is supplied so that a temperature lowering of the fixing belt 1 in the sheet passing region is minimum.

The type of the recording material P is plain paper (CLC, basis weight=80 g/m$^2$) and an environmental condition is a temperature of 23° C. and a humidity of 50% RH. The temperature of the fixing belt 1 for temperature control is set at 160° C. Here, the recording material P (CLC, 80 g/m$^2$) is used, but in the case where the recording material P with a smaller basis weight of 64 g/m$^2$ (CLC, 64 g/m$^2$), the pitch width is set at 2.5 mm and a frequency of the sheet passing of the recording material P through the end portion of the region A in which the degree of the temperature rise is slow is lowered. This is because when the basis weight is small, correspondingly to a small electric power supplied, the temperature rise speed of the recording material P at the end portion is slow.

FIG. 9 shows a longitudinal temperature distribution immediately before the sheet passing of the recording material P and that in the case where the recording material P is subjected to the sheet passing without being reciprocated. In the case where the recording material P is subjected to the sheet passing without being reciprocated, with respect to the longitudinal temperature distribution, a large degree of the temperature rise occurs at the recording material end portion. This is because, compared with the region A in which the heat generation amount is increased by the outside magnetic cores 7*a*, the width B of the recording material P is small and thus the temperature rise occurs in a resultant non-overlapping region.

As shown in FIG. 9, the longitudinal temperature distribution immediately before the sheet passing of the recording material P is uniform in the sheet passing region but at the time of the sheet passing on 50th sheet, a temperature difference between the sheet passing region and the recording material end portion exceeds the durability temperature of the fixing belt 1.

Therefore, the reciprocation of the recording material P is started before the recording material end portion temperature is increased. Here, with respect to timing of start of the reciprocation of the recording material, the sheet passing number in which the fixing belt temperature is not more than a temperature (hot-offset temperature) at which the melted toner is deposited on the fixing belt 1 due to excessively high temperature of the recording material end portion is selected.

That is, as shown in FIG. 10, at the time of sheet passing on 10th sheet when the recording material end portion temperature is not so increased, the recording material P is reciprocated by the recording material shift mechanism 11 by 5 mm each of the end portions of the recording material P in the longitudinal direction.

As shown in FIG. 11, in the case where the recording material P is not reciprocated, the fixing belt temperature exceeds the durability limit temperature of the fixing belt 1 at the time of sheet passing on 50th sheet. On the other hand, in the case where the recording material P is reciprocated in the first region W1, even at the time of sheet passing on the 50th sheet, the temperature at the recording material end portion show a value considerably smaller than the fixing belt durability limit temperature.

As shown in FIG. 12, when the sheet passing number was increased from 50th to 100th, it was tuned out that the temperature does not exceed the fixing belt durability limit temperature but is largely increased at positions outside the first region W1. Therefore, the recording material P passes through a range extended by one level with the reciprocation range of the recording material P ranging to the second region W2 in which the image fixability equivalent to that at a central portion can be obtained.

Also in this case, similarly as at the time of start of the reciprocation of the recording material P in the first region W1, the reciprocation of the recording material P in the second region W2 is predictively started without awaiting the sheet passing o 100th sheet. That is, at the time of sheet passing on 50th sheet when the temperature of the fixing belt 1 at the recording material end portion is not more than the offset temperature, the reciprocation range of the recording material is further extended to the outside by 5 mm at each of the end portions with respect to the longitudinal direction by using a lateral registration control means 11.

In the thus extended second region W2, as shown in FIG. 11, the temperature is already not less than that in the first region W1 at the time of sheet passing on 50th sheet and the fixed image equivalent to that in the sheet passing region can be obtained. The reciprocation range of the recording material P at this time is 10 mm, at each of the end portions of the recording material P, as the second region W2 including the first region W1. The movement (shift) pitch width every one movement by the recording material shift mechanism 11 is 5 mm.

As shown in FIG. 13, in the case where the recording material P is reciprocated only in the first region W1 from the time of sheet passing on the 10th sheet, the fixing belt temperature exceeds the fixing belt durability limit temperature at the time of sheet passing on 200th sheet. On the other hand, in the case where the reciprocal range of the recording material P is extended to the second region W2 from the time of sheet passing on the 50th sheet, even at the time of sheet passing on the 200th sheet, the temperature rise at the recording material end portions is little observed.

As shown in FIG. 14, in the case where the reciprocation range of the recording material P is extended to the second region W2 from the time of sheet passing on the 50th sheet, the temperature rise at the recording material end portions was not observed even when the sheet passing number was increased from the 200th sheet to 500th sheet.

When the above-described experiment was repeated to check the surface state of the fixing belt 1, in the case where the recording material P was not reciprocated, the durability sheet passing number of the fixing device in the constitution in this embodiment was not more than 100,000 sheets and peeling of the surface parting layer 1*c* of the fixing belt 1 was observed. On the other hand, in the case where the recording material shift mechanism 11 was actuated with the above-described timing, the sheets of the recording material P was able to be subjected to continuous sheet passing at the temperature not more than the durability limit temperature of the fixing belt 1 and therefore it was possible to achieve a target durability sheet passing number of 500,000 sheets.

Incidentally, the control circuit portion 102 shorten the interval, at which the region with respect to the widthwise direction in which the recording material P is passed, with an image heating condition in which the thermal quality taken per unit time in the heating nip N by the recording material P is larger.

In other words, the control circuit portion 102 set the first cumulative number of heated sheets and the second cumulative number of heated sheets at smaller values with an increase of the weight of the recording material P per unit area. The control circuit portion 102 sets the first cumulative number of heated sheets and the second cumulative number of heated sheets with an increase of the number of sheets of the recording material subjected to heating per unit time.

That is, in this embodiment, the plain paper (CLC, 80 g/m$^2$) is used for study, but with respect to the paper type with a larger basis weight, there is a need to set the temperature for temperature control at a higher value. As a result, the reciprocation of the recording material is started at the time of sheet passing on a smaller sheet number (5th sheet in the case of paper (CLC, 105 g/m$^2$)) since a margin for the durability limit temperature of the fixing belt 1 is small.

Further, in this embodiment, 58 sheets of the A4-sized recording material are subjected to sheet passing per minute, but in the case where the sheet feeding interval is smaller, the temperature rise speed at the recording material end portion is also slow correspondingly to the decrease of the electric power supplied. For this reason, the reciprocation of the recording material is started from the time of sheet passing on a larger sheet number (20th sheet in the case where 30 sheets of the A4-sized recording material are subjected to sheet passing per minute)>

Embodiment 3

Parts (a) and (b) of FIG. 15 are illustrations of a structure of a fixing device used in Embodiment 3. Part (a) of FIG. 15 is an enlarged cross-sectional side view of a principal portion of the fixing device as the image heating apparatus in this embodiment, and part (b) of FIG. 15 is a sectional view of a magnetic flux-shielding means 14.

As shown in (a) of FIG. 15, in this embodiment, the exciting coil 6 is provided inside the fixing belt 1, and a copper plate which is a magnetic flux-shielding plate is used for setting the heating width at a plurality of levels, depending on the recording material size, with respect to the heating belt 1. Incidentally, in this embodiment, constituent portions having the same functions as those in Embodiment 1 are represented by the same reference numerals or symbols and will be omitted from redundant description.

In a fixing device B, between the heating medium and the induction heating source, the magnetic-shielding means (14) for partly shielding the magnetic flux sent from the induction heating source to the heating medium is disposed and a displacing means for changing the position of the magnetic-shielding means is also provided. By providing and moving the magnetic-shielding means, the magnetic flux sent from the induction heating source is shielded at a portion other than a necessary portion to suppress the heat generation itself, so that control of a heat generation range is in the fixing nip effected and thus it becomes possible to control a heat distribution of the heating medium to be increased in temperature.

Specifically, in the cylindrical fixing belt 1, a holder 13 for supporting the exciting coil 6 and a magnetic core 2 disposed for enhancing the heat generation efficiency is inserted and provided. A magnetic flux-shielding member 14 is disposed between the holder 13 and the fixing belt 1.

The magnetic flux-shielding member 14 is provided in a gap between the fixing belt 1 and the holder 13 but includes a movable mechanism for being moved toward a predetermined magnetic flux adjusting position and a retracted position where the magnetic flux adjustment is not performed. As a material for the magnetic flux-shielding member 14, in order to prevent the temperature rise of the magnetic flux-shielding member 14 itself, a non-magnetic material, which is an electroconductive material for permitting induction current conduction and is small in specific resistance, such as copper, aluminum, silver or their alloys; or ferrite or the like having a large specific resistance is suitable.

As shown in (b) of FIG. 14, the magnetic flux-shielding member 14 has a stepwise shape and is moved in the rotational direction of the fixing belt 1, thus being moved to a position between opposing positions of the fixing belt 1 and the exciting coil 6 and thus the magnetic flux distribution with respect to the longitudinal direction is adjusted.

Also in such an fixing device B, by effecting control similar to that in Embodiment 1, even at the time of sheet passing on the 50th sheet, the temperature rise of the fixing belt 1 at the recording material end portion positions was little observed.

As described above, the image heating apparatus of the present invention enlarges the sheet passing region of the recording material by controlling the above-described shift mechanism in synchronism with movement of the overheating region generated outside the sheet passing width of the recording material after continuous heating is started. For this reason, local overheating of the heating belt member can be avoided.

In the above-described embodiments, the change of the sheet passing region is made depending on the number of sheets subjected to the image formation but may also be made on the basis of, e.g., a detection result of the temperature of the image heating member at the end portions.

Further, in the above-described embodiments, the switching is effected between the first region and the second region but it is also possible to employ a constitution in which a third region is set as a new range and the region is selected among the first region, the second region and the third region.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 021464/2011 filed Feb. 3, 2011, which is hereby incorporated by reference.

What is claimed is:

1. An image heating apparatus comprising:

a rotatable image heating member configured to heat an image on a recording material;

magnetic flux generating means for generating magnetic flux for heating said image heating member;

adjusting means for adjusting a magnetic flux distribution so that the magnetic flux acting on an end portion region of said image heating member with respect to a rotational axis direction of said image heating member is decreased;

changing means for changing a sheet passing position of the recording material with respect to the rotational axis direction within a set range; and switching means for switching, when said adjusting means is actuated and sheets of the recording material are continuously passed, the set range from a range in which the sheet passing position does not overlap with the end portion region to a range in which the sheet passing position overlaps with the end portion region, wherein said switching means effects switching when the number of sheets subjected to image formation reaches a predetermined value, and wherein the predetermined value when the sheets of the recording material with a first basis weight are passed is smaller than that when the number of sheets subjected to image formation when the sheets of the recording material with a basis weight smaller than the first basis weight are passed.

2. An apparatus according to claim 1, wherein said magnetic flux generating means includes a coil and a plurality of cores, and wherein said changing means moves the core opposing the end portion region at each of longitudinal ends of said image heating member in a direction in which the core is spaced from said image heating member more than the core opposing a central portion region of said image heating member, thereby adjusting the magnetic flux distribution so that the magnetic flux acting on the end portion region said image heating member is decreased.

3. An apparatus according to claim 2, wherein a reciprocation interval between the end portion region at each of the longitudinal ends of the said image heating member is larger than a width of the passed sheets of the recording material.

4. An image heating apparatus comprising:

a rotatable image heating member for heating an image on a recording material;

magnetic flux generating means for generating magnetic flux for heating said image heating member;

adjusting means for adjusting a magnetic flux distribution so that the magnetic flux acting on an end portion region of said image heating member with respect to a rotational axis direction of said image heating member is decreased;

changing means for changing a sheet passing position of the recording material with respect to the rotational axis direction; and an executing portion capable of executing, when said adjusting means is actuated and sheets of the recording material are continuously passed, an operation in a first mode in which the sheet passing position is changed within a range in which it does not overlap with the end portion region and an operation in a second mode in which the sheet passing position is changed within a range in which it overlaps with the end portion region, wherein said executing portion effects mode switching when the number of sheets subjected to image formation reaches a predetermined value, and wherein the predetermined value when the sheets of the recording material with a first basis weight are passed is smaller than that when the number of sheets subjected to image formation when the sheets of the recording material with a basis weight smaller than the first basis weight are passed.

5. An apparatus according to claim 4, wherein said magnetic flux generating means includes a coil and a plurality of cores, and wherein said changing means moves the core opposing the end portion region at each of longitudinal ends of said image heating member in a direction in which the core is spaced from said image heating member more than the core opposing a central portion region of said image heating member, thereby adjusting the magnetic flux distribution so that the magnetic flux acting on the end portion region said image heating member is decreased.

6. An apparatus according to claim 5, wherein a reciprocation interval between the end portion region at each of the longitudinal ends of the said image heating member is larger than a width of the passed sheets of the recording material.

7. An image heating apparatus comprising:

an image heating member configured to heat a toner image on a sheet at a nip portion;

an excitation coil provided outside of said image heating member and configured to generate magnetic flux for heating said image heating member;

a plurality of magnetic cores provided outside of said image heating member so as to be arranged in a longitudinal direction of said image heating member and configured to direct the magnetic flux toward said image heating member;

a moving mechanism configured to move at least one of said magnetic cores between a first position and a second position which is more remote from said image heating member than the first position;

a control portion configured to control a number of at least one, of said magnetic cores, to be placed in the second position based on a width of the sheet; and a changing mechanism configured to change the relative positional relationship between a passing region of the sheet in the nip portion and said magnetic cores in the longitudinal direction, wherein when the toner image on a predetermined sheet having a width which is narrower than a maximum width of the sheet usable in said apparatus is heated, said changing mechanism changes the relative positional relationship so that the passing region of the sheet is not beyond two magnetic cores which are in both ends, of the magnetic core group which is placed at the first position, with respect to the longitudinal direction.

8. An apparatus according to claim 7, wherein said changing mechanism changes the relative positional relationship when a predetermined number of the predetermined sheets are passed in the nip portion.

9. An apparatus according to claim 8, wherein when the predetermined sheet is a thin sheet, said changing mechanism changes the relative positional relationship when a first number of the predetermined sheets are passed in the nip portion, and wherein when the predetermined sheet is a thick sheet having a thickness which is larger than the thin sheet, said changing mechanism changes the relative positional relationship when a second number, which is smaller than the first number, of the predetermined sheets are passed in the nip portion.

10. An apparatus according to claim 9, wherein said changing mechanism shifts the passing region of the sheet relative to said magnetic cores.

11. An apparatus according to claim 7, wherein said changing mechanism shifts the passing region of the sheet relative to said magnetic cores.

* * * * *